US006814580B2

(12) United States Patent
Li et al.

(10) Patent No.: US 6,814,580 B2
(45) Date of Patent: Nov. 9, 2004

(54) ROTATABLE CONNECTOR

(75) Inventors: Li-Heng Li, Tucheng (TW); Ming-Gang Mu, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/403,290

(22) Filed: Apr. 1, 2003

(65) Prior Publication Data

US 2004/0198085 A1 Oct. 7, 2004

(51) Int. Cl.[7] ..... H01R 39/00
(52) U.S. Cl. ..... 439/6; 439/446
(58) Field of Search ..... 439/6, 8, 446, 439/640

(56) References Cited

U.S. PATENT DOCUMENTS 3,012,798 A * 12/1961 Berger ..... 285/264
3,936,026 A * 2/1976 Hampel et al. ..... 248/349.1
5,915,974 A * 6/1999 Carter ..... 439/439
6,332,794 B1 * 12/2001 Tzeng Jeng ..... 439/188
6,576,852 B1 * 6/2003 Shu ..... 200/51 R
6,595,782 B1 * 6/2003 Hsiao ..... 439/13

* cited by examiner

*Primary Examiner*—Thanh-Tam Le
(74) *Attorney, Agent, or Firm*—Rosenberg, Klein & Lee

(57) ABSTRACT

A rotatable connector comprises a pedestal, a spring, a holding plate, a universal coupling and a receptacle. The pedestal has a base plate, several ledges and a pair of pillars extending upwardly from the base plate. The pillars stand opposite sides of the base plate and outside the ledges. Each pillar has a hole therein. The spring is arranged to encase the ledges. A plurality of bulges is projected outwardly from an outer edge of the holding plate and pressed on the spring. The universal coupling has a first pivot, a second pivot and a shaft. The first and the second pivots are pivotally engaged by the shaft. Ends of the first pivot are pivotally inserted into the holes of the pillars. One end of second pivot engages with the holding plate, while the other end is fixed to the receptacle. The receptacle is electrically and mechanical connected to a cable end plug. Due to the universal coupling pivotally attaching to the pedestal, the rotatable connector can revolve following the plug's rotation, thereby avoiding the cable entangled.

11 Claims, 3 Drawing Sheets

ROTATABLE CONNECTOR

BACKGROUND OF THE INVENTION

1. Field of the Invention

The present invention relates to a rotatable connector for electrical connection, and more particularly, to a rotatable connector having a universal coupling in order to avoid a cable entangled.

2. The Related Art

Electrical connectors, as a common element that can be generally contacted by technical personnel, have an extensive application field. With respect to specific electrical equipments in which the electrical connector is used, it has an according request for connector structure corresponding to different purposes provided by the application of the electrical connector.

At present, connector designers pay particular attention to achieve a variety of performance through making some certain improvements on the connector structure, i.e., simplifying constitution structure, realizing reliable electrical connection, or reducing the dimension and weight of the electrical connector.

Although these variance designs as mentioned previously, can make a great progress on the application of electrical connectors, another demand, that is how to achieve a flexible connection between the electrical connector and the exterior electrical apparatus, and avoid a cable entangled, is ignored.

As well-known, due to a movement of the exterior electrical apparatus, a cable that is connects between the electrical connector and the exterior electrical apparatus, especially a part approached to a cable end plug, would be tangled frequently. This tangled cable not only influences beauty of the electrical equipment, but also results a bending stress and a stress concentration about the cable, further leads to the cable's life-span reduction, and even causes the cable damage or break.

SUMMARY OF THE INVENTION

Thus, an object of the present invention is to provide a rotatable connector capable for revolving following with the plug's rotation, thereby avoiding the cable entangled.

To attain the above object, the present invention provides a rotatable connector which comprises a pedestal, a spring, a holding plate, a universal coupling and a receptacle. The pedestal has a base plate, several ledges and a pair of pillars extending upwardly from the base plate. The pillars stand opposite sides of the base plate and outside the ledges. Each pillar has a hole therein. The spring is arranged to encase the ledges. A plurality of bulges are projected outwardly from an outer edge of the holding plate and pressed on the spring. The universal coupling has a first pivot, a second pivot and a shaft. The first and the second pivots are pivotally engaged by the shaft. Ends of the first pivot are pivotally inserted into the holes of the pillars. One end of second pivot engages with the holding plate, while the other end is fixed to the receptacle. The receptacle is electrically connected to a cable end plug. Due to the universal coupling pivotally attaching to the pedestal, the rotatable connector can revolve following the plug's rotation, thereby avoiding the cable entangled.

BRIEF DESCRIPTION OF THE DRAWINGS

A detailed explanation of a preferred mode of the present invention will be given, with reference to the attached drawings, for better understanding thereof to those skilled in the drawings.

DETAILED DESCRIPTION OF THE BEST MODE FOR CARRYING OUT THE PRESENT INVENTION

Figure 1:
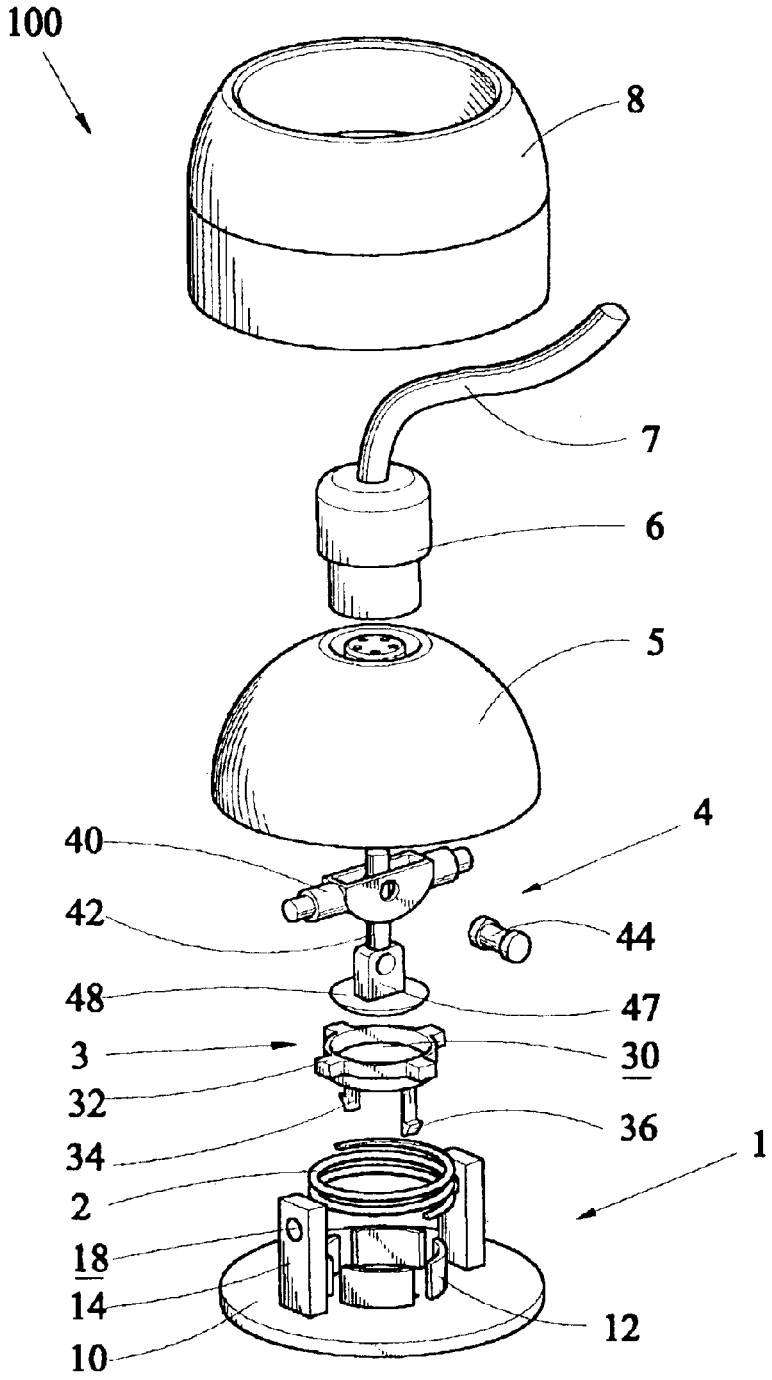
FIG. 1 is an exploded view of a rotatable connector in accordance with the present invention.

With reference to the FIG. 1, a rotatable connector, in accordance with the present invention, generally designed with reference numeral 100, comprises a pedestal 1, a spring 2, a holding plate 3, a universal coupling 4, a receptacle 5, a plug 6, a cable 7 and a housing 8.

Figure 2:
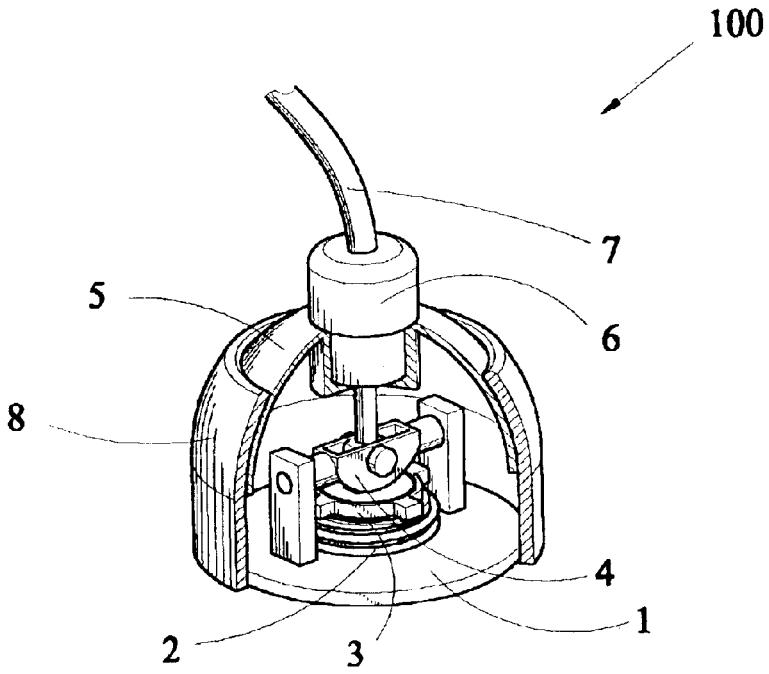
FIG. 2 is a view of the rotatable connector with a receptacle and a housing dissected to show inside details.
Figure 3:
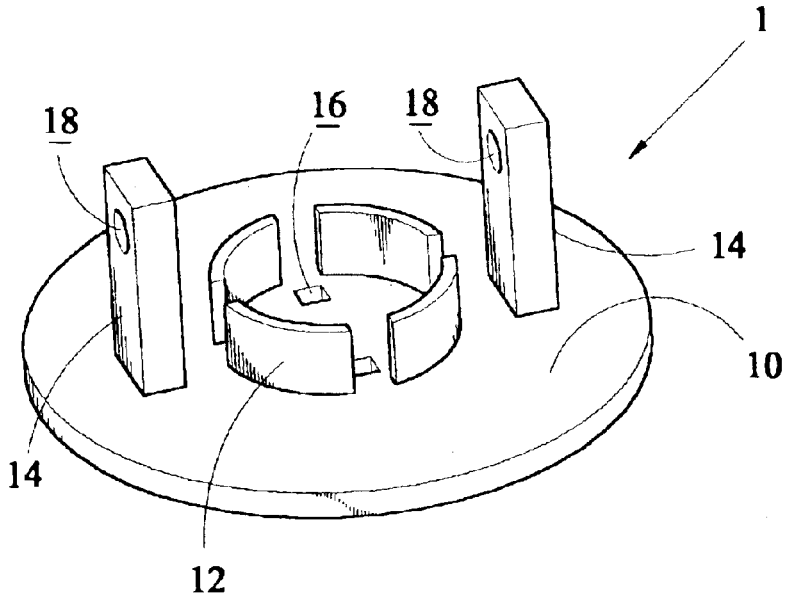
FIG. 3 is an enlarged view of a pedestal of the rotatable connector.

As shown in FIG. 1 to FIG. 3, the pedestal 1 has a base plate 10 and several ledges 12 extending upwardly from a middle part of the base plate 10. The several ledges 12, as this embodiment illustrated, are four camber ledges which are disposed in a circumference position to form a cylinder, and defines four gaps therebetween. Two apertures 16 are formed inside a space surrounded by the several ledges 12 in the base plate 10. A pair of pillars 14 which are parallel each other are extended perpendicular to the base plate 10, standing opposite sides of the base plate 10 and outside the space surrounded by the several ledges 12. A couple holes 18 are formed on the pillars 14.

The spring 2 is arranged to encase the cylinder formed by the ledges 12, and fixed between the cylinder and the pillars 14.

Figure 4:
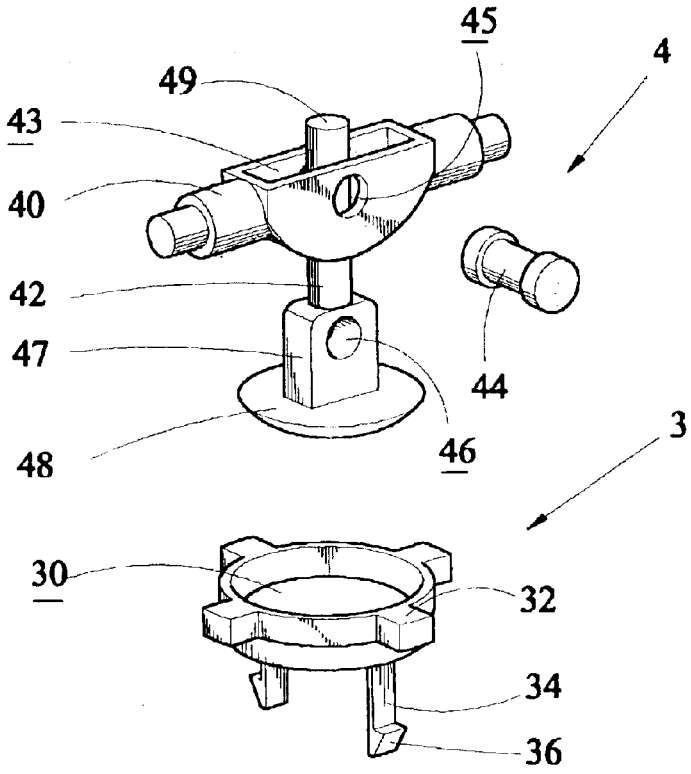
FIG. 4 is an exploded view of an universal coupling and a holding plate of the rotatable connector.

Referring now to FIG. 1 and FIG. 4, a recess 30 is formed on the top of the holding plate 3. Four bulges 32 which face exactly the gaps defined by the ledges 12 are projected symmetrically outwardly from an outer edge of the holding plate 3 and press on the spring 2. A bottom part of the holding plate 3 is encased by the spring 2. A pair of hook feet 34 is protruded downwardly from a bottom side of the holding plate 3. Each hook foot 34 has a hook 36 formed on an end portion thereof to clasp a bottom side of the base plate 10, when the hook feet 34 insert correspondingly into the apertures 16.

While the holding plate 3 bears an external force, the bulges 32 of the holding plate 3 press the spring 2 to move downwardly. After the external force is relieved, the spring 2 withstands upwardly the bulges 32 through an elastic recoil caused by an elastic deformation of the spring 2, so that the holding plate 3 generates an upward movement tendency. However the holding plate 3 is still connected to the base plate 10 in virtue of a co-operation between the hook feet 34 and the base plate 10. Furthermore, the holding plate 3 can't generate a horizontal displacement relative to the base plate 10.

The universal coupling 4 which shapes a cross is provided with a first pivot 40, a second pivot 42 and a shaft 44. An up-down through-hole 43 and a first front-behind through-hole 45 which penetrates the up-down through-hole 43 are located on an intermediate part of the first pivot 40. A displacement disk 48 is formed on a bottom end of the second pivot 42 to engage with the recess 30 of the holding plate 3. A fixed post 49 is defined on a head end of the second pivot 42. A bearing part 47 which has a second front-behind through-hole 46 is located on a middle portion of the second pivot 42.

In assembling, the fixed post 49 of the second pivot 42 passes through the up-down through-hole 43, and the bearing part 47 is wrapped in the up-down through-hole 43. The first and the second pivots 40, 42 are pivotally engaged by the shaft 44, as the shaft 44 passes through the first and the second front-behind through-holes 45, 46. The first pivot 40 has both end parts thereof pivotally inserted into the holes 18 of the pillars 14 of the pedestal 1 in order to be rotatably pivoted therein. Thus, the universal coupling 4 is movably engaged with the pedestal 1.

The receptacle 5 encloses the universal coupling 4, meanwhile the fixed post 49 of second pivot 44 securely engages with a bottom of the receptacle 5. A mating portion formed on a head of the receptacle 5 electrically and mechanically connects with the plug 6. The cable 7 is connected between the plug 6 and an electrical equipment (not shown).

The housing 8 encases the receptacle 5 and buckles the pedestal 1 in order to assemble the rotatable connector 100 of the present invention.

As shown in FIG. 2, when the rotatable connector 100 of the present invention maintains a stationary station, the pedestal 1, the spring 2, the holding plate 3 and the universal coupling 4 are combined to an integrated portion. As detailed described herein, the holding plate 3 moves downwardly by means of a pressure of the displacement disk 48 of the universal coupling 4 when the universal coupling 4 pivotally engages the pillars 18. Thus, the ledges 32 of the holding plate 3 have the spring 2 resulted an elastic deformation. In accordance with the pressure and an elastic recoil caused by the elastic deformation of the spring 2, the holding plate 3 maintains a force balance.

Figure 5:
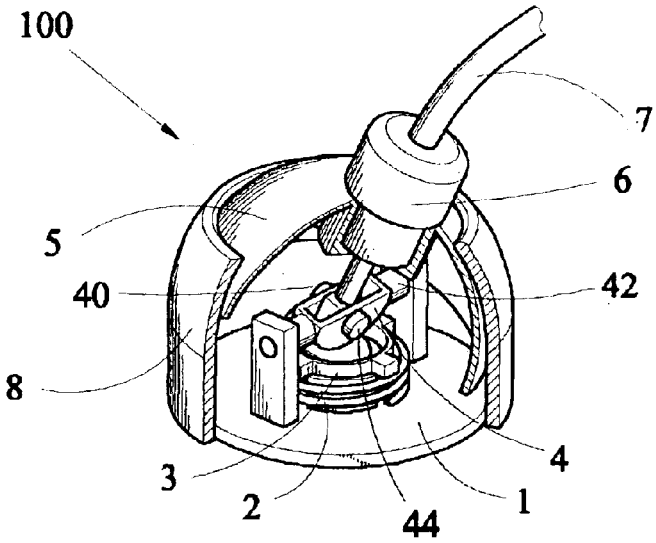
FIG. 5, similar to FIG. 2, shows rotation state of the rotatable connector of the present invention.

Referring to FIG. 5, when an electrical equipment, which is connected to the cable 7 of the rotatable connector 100 of the present invention, swings in any direction, the second pivot 42 of the universal coupling 4 makes a pivotal rotation of a first direction around the shaft 44 as a rotary axis in the up-down through-hole 43 of the first pivot 40 and makes a pivotal rotation of a second direction by means of which the ends of the first pivot 40 of the universal coupling 4 pivotally rotates in the holes 18. Owing to the first and the second directions of rotation of the second pivot 42, the displacement plate 48 revolves and slants in the recess 30 of the holding plate 3, so the second pivot 42 presses the holding plate 3 to move downwardly, then the bulges 32 of the holding plate 3 lodge in the gaps formed by the ledges 12. The holding plate 3 can form a specific inclined degree because of a free movement of the bulges 32 in the gaps, and allow the second pivot 42 rotating preferably unrestricted.

According to the first and the second directions of rotation of the second pivot 42, the rotatable connector 100 of the present invention can rotate in a certain scope, therefore avoiding the cable entangled. Moreover, the rotatable connector 100 of the present invention can restore a previous non-rotation state, as a result of the elasticity of the spring 2, as soon as the electrical equipment connected to the cable 7 terminates swing.

If a rotation range of the universal coupling 4 has to be restricted, further steps can be arranged on the first and second pivots 40, 42 and the holding plate 3. A restrictive engagement between the plug 6 and the housing 8 also can be provided to restrict the rotation range. It is a common technique for those skilled in the art, thereof, no further disclosure is required in this specification.

Although a particular embodiment of the invention has been described in detail for purposes of illustration, additional advantages and modifications will readily appear to those skilled in the art, and various modifications and enhancements may be made without departing from the spirit and scope of the invention. Accordingly, the invention is not to be limited except as by the appended claims.

What is claimed is:

1. A rotatable connector comprising:

a pedestal having a base plate, a plurality of ledges and a plurality of pillars extending upwardly from the base plate, the pillars standing opposite sides of the base plate and outside the ledges, each pillar having a hole therein;

a spring arranged encasing the ledges;

a holding plate having a plurality of bulges that project outwardly from an outer edge of the holding plate and press on the spring;

a universal coupling having a first pivot, a second pivot and a shaft, the first pivot having a through-hole which is passed through by the second pivot, each of the first and second pivot having a through-hole which is passed through pivotally by the shaft, both ends of the first pivot pivotally inserting into the holes of the pillars, one end of the second pivot engaging with the holding plate; and a receptacle having a bottom thereof engaged with the other end of the second pivot, a mating portion of the receptacle adapting to electrically and mechanically connecting with a cable end plug.

2. The rotatable connector as claimed in claim 1, wherein the ledges form a plurality of gaps.

3. The rotatable connector as claimed in claim 1, wherein the base plate has a plurality of apertures and the holding plate has a plurality of hook feet, so that each hook foot engages with the aperture.

4. The rotatable connector as claimed in claim 1, wherein each of the hook feet has a hook to clasp the aperture.

5. The rotatable connector as claimed in claim 1, wherein the second pivot has a displacement disk formed on a bottom end of the second pivot to engage with a recess formed on top of the holding plate.

6. The rotatable connector as claimed in claim 1, further comprising a housing encasing the receptacle and buckling the pedestal.

7. A rotatable connector comprising:

a pedestal having a base plate, a plurality of ledges and a plurality of pillars extending upwardly from the base plate, the pillars standing opposite sides of the base plate and outside the ledges, each pillar having a hole therein;

a spring arranged encasing the ledges;

a holding plate having a plurality of bulges that project outwardly from an outer edge of the holding plate and press on the spring;

a universal coupling having a first pivot, a second pivot and a shaft, the first pivot having a through-hole which is passed through by the second pivot, each of the first and second pivot having a through-holes which is passed through pivotally by the shaft, both ends of the first pivot pivotally inserting into the holes of the pillars, one end of the second pivot engaging with the holding plate;

a receptacle having a bottom thereof engaged with the other end of the second pivot, a mating portion formed on a head of the receptacle;

a plug connected between a cable and the mating portion of the receptacle; and a housing encasing the receptacle and buckling the pedestal.

8. The rotatable connector as claimed in claim 7, wherein the ledges form a plurality of gaps therebetween.

9. The rotatable connector as claimed in claim 7, wherein the base plate has a plurality of apertures and the holding plate has a plurality of hook feet, so that each hook foot engages with the aperture.

10. The rotatable connector as claimed in claim 7, wherein each of the hook feet has a hook on end portion thereof to clasp the aperture.

11. The rotatable connector as claimed in claim 7, wherein the second pivot has a displacement disk formed on a bottom end of the second pivot to engage with a recess formed on top of the holding plate.

* * * * *